United States Patent [19]

Coons

[11] Patent Number: 4,830,571

[45] Date of Patent: May 16, 1989

[54] PNEUMATIC STARTERS

[75] Inventor: Terry L. Coons, Dayton, Ohio

[73] Assignee: Tech Development Inc., Dayton, Ohio

[21] Appl. No.: 832,831

[22] Filed: Feb. 24, 1986

[51] Int. Cl.[4] ..... F01B 17/06

[52] U.S. Cl. ..... 415/36; 415/42

[58] Field of Search ..... 415/36, 41, 19, 25, 415/42, 190, 183, 184, 185, 216–218

[56] References Cited

U.S. PATENT DOCUMENTS

| | | | |
|---|---|---|---|
| 3,073,114 | 1/1963 | Wood | 415/36 X |
| 3,574,476 | 4/1971 | Jacomet | 415/36 |
| 4,288,677 | 9/1981 | Sakata et al. | 415/185 X |
| 4,518,310 | 5/1985 | Coons | 415/36 |
| 4,571,945 | 2/1986 | Inaoa et al. | 415/36 X |

FOREIGN PATENT DOCUMENTS

| | | | |
|---|---|---|---|
| 1326037 | 3/1963 | France | 415/190 |

*Primary Examiner*—Robert E. Garrett
*Assistant Examiner*—Joseph M. Pitko
*Attorney, Agent, or Firm*—Jerome P. Bloom

[57] ABSTRACT

Pneumatic starters including a housing formed in sections interfit in telescopic and abutted relation, a cap forming its upstream end, a nozzle unit at the open end of said cap defining therewith a shallow chamber constructed to receive a flow of fluid under pressure to power said rotor and provide for its content a substantial pressure head, said end cap and nozzle unit being coaxially extended by a turbine assembly section, the rotor of which positions outwardly of the end thereof immediately adjacent said nozzle unit, positioning its buckets in coaxially aligned relation to its nozzles, said rotor nesting in a relatively axially extended portion of a cylindrical wall structure which forms a shroud for said nozzle unit, lines the inner wall of said housing and peripherally shrouds the buckets of said rotor, said nozzle unit being separable and interchangeable, said inlet chamber and required interrelation of the nozzles of said nozzle unit and the buckets of said rotor being achieved in assembly of said housing sections, a following downstream section of said housing mounting a trip valve assembly in its all structure and containing a drive transmission including a drive shaft coaxially coupled with and driven by the rotor drive shaft and having means connected therewith for normally maintaining said trip valve in inactive condition, and an associated fluid signalling and delivery system providing fluid to energize said starter and insuring automatic shut down thereof substantially simultaneously with the speed of rotation of said rotor exceeding a preset limit.

18 Claims, 6 Drawing Sheets

FIG-7
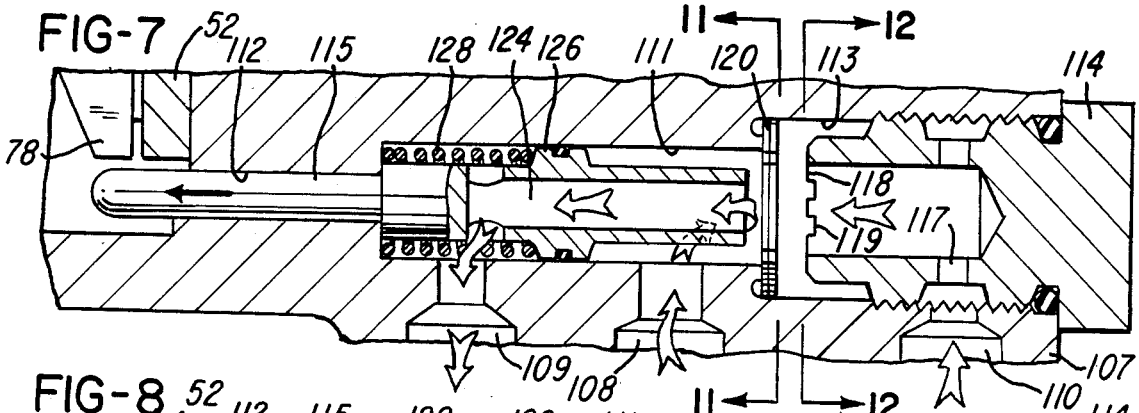
FIG-8
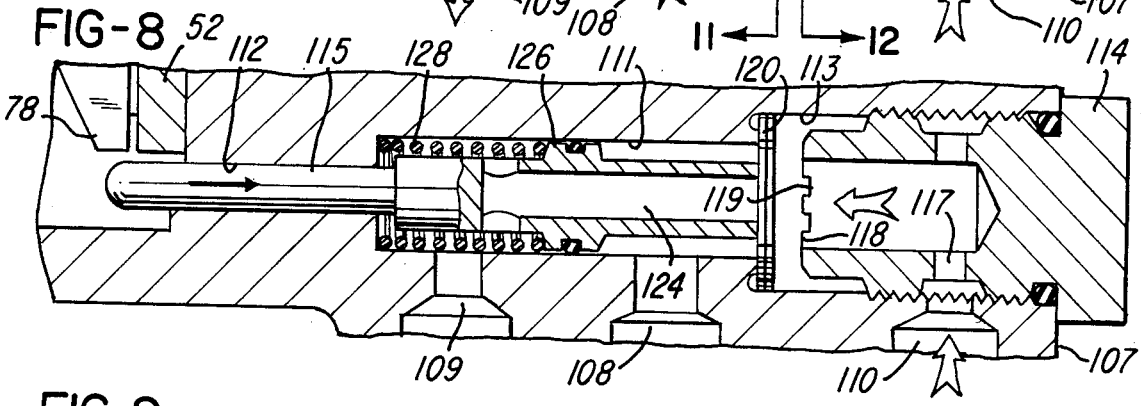
FIG-9
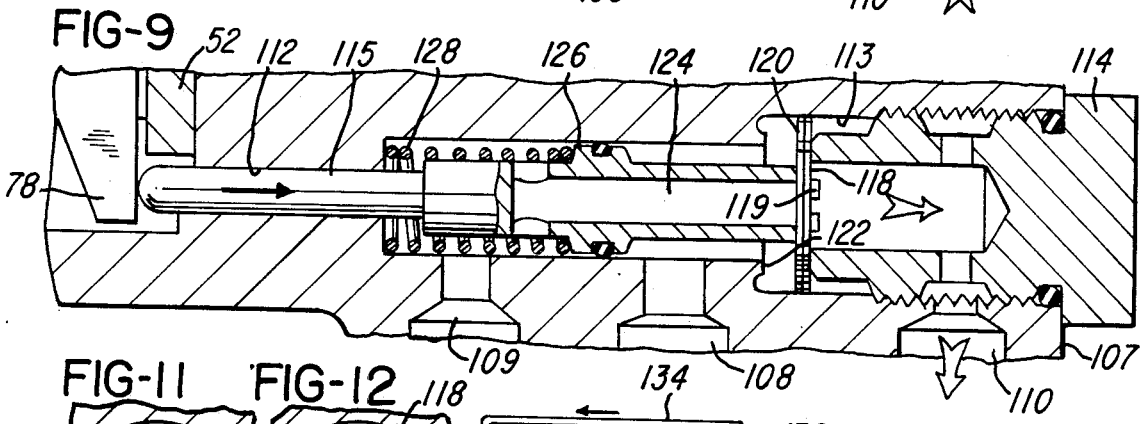
FIG-11
FIG-12
FIG-10
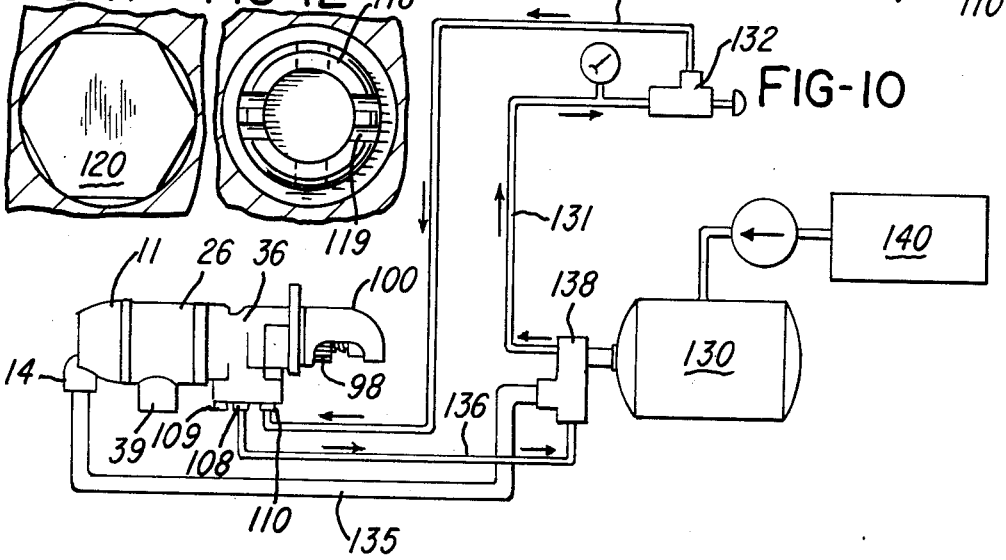

PNEUMATIC STARTERS

BACKGROUND OF THE INVENTION

This invention relates to improvements in pneumatic starters.

It provides a device of this nature having a compact, simplistic construction featuring a new and improved means and mode of channeling and utilizing the gaseous fluid applied to drive its turbine rotor which produce a most effective control of the temperature of its bearings, gear box and housing, by virtue of which to render such a device more efficient, more effective and more satisfactory in use and minimize its maintenance requirements.

It further provides a pneumatic starter having a highly advantageous means and manner of construction and application of its nozzle unit which facilitates a ready interchange thereof and at the same time a simpler and more efficient way to shroud its turbine rotor.

It also provides pneumatic starters having a new and improved highly advantageous means and manner of construction and application thereto of a control system for achieving an automatic shut down should the speed of rotation of the embodied turbine rotor reach its predetermined design limit and automatic conditioning thereof for an immediate restart.

Any one or more of the improvements herein set forth may be utilized not only in pneumatic starters but also in other turbine powered devices and endow them with significant benefits which contribute thereto an advance in the pertinent art.

Most importantly, the present invention solves an additional long standing problem in the art to which it primarily relates in that it enables the production of a pneumatic engine starter sufficiently compact, sufficiently efficient, sufficently dependable, sufficiently safe, sufficiently reasonable in cost and sufficiently maintenance free to render possible a general use thereof throughout industry.

The following patents represent the only prior art of which the present inventor is aware which has specific pertinence to the improvements of the invention herein set forth:

U.S. Pat. No. 4,518,310 issued May 21, 1985

U.S. Pat. No. 4,507,047 issued Mar. 26, 1985.

As will be seen, on inspection of the foregoing patents, the first has only peripheral pertinence as to the current state of the prior art and the second is incorporated herein by reference, in respect to the details of the turbine rotor referred to by way of example in the body of the following specification.

SUMMARY OF THE INVENTION

One embodiment of this invention provides a pneumatic starter featuring a new and improved construction and arrangement of its housing and its nozzle unit wherein the housing is formed in sections one of which forms part of and provides the bounding wall portion of its turbine assembly, outwardly of one end of which is positioned its turbine rotor. The nozzle unit and an end cap section of said housing are located upstream of and so applied as to cap said one end of said turbine assembly and said rotor. Said nozzle unit and end cap section define therebetween an air inlet chamber which is not only upstream of said nozzle unit but so constructed and arranged to provide that air introduced therein under pressure is directed therefrom in a relatively uniformly maintained pressured flow which moves to and through said nozzle unit, impinges on the rotor buckets in a manner to utilize the major portion of its energy content to drive said rotor and then in its spent form moves therefrom to and through a discharge chamber defined within said housing section which forms part of said turbine assembly to finally exit from said housing by way of an exhaust opening in a portion of the wall thereof which bounds said discharge chamber. The spent fluid, which is relatively cool as it commences its movement through said discharge chamber, further cools by virtue of its expansion therein. Resultingly this fluid, in the course of its movement through and from said chamber serves admirably to cool and maintain a moderate temperature of the bearings, seals, gear boxes and other critical portions of the power transmission system and controls interrelated with said rotor in the function of said starter. In a preferred form of said embodiment said nozzle unit is provided with a peripheral shroud which is extended to project outwardly therefrom and coaxially thereof to serve in the assembly of said nozzle unit to said turbine assembly to provide a liner for that portion of the inner surface of said housing which bounds said rotor and at the same time a shroud for the rotor buckets. As will be seen each of these embodiments provide a starter or like device having a compact, simplistic construction featuring a new and improved means and mode of channeling and utilizing the gaseous fluid applied to drive its turbine rotor and a most effective control of the temperature of its components. Furthermore, as will be readily apparent, the construction and arrangement for application of said nozzle unit facilitates a ready interchange thereof and at the same time a simple, safer and more efficient way to shroud the interrelated turbine rotor.

A further embodiment of the invention provides pneumatic starters with a housing incorporating therein a new and improved construction and arrangement of a highly advantageous air valve assembly and controls therefor which directly respond to the speed of rotation of the turbine rotor and provide a simply protected and easily maintained control system for achieving an automatic shut down should the speed of rotation of the embodied turbine rotor reach its design limit and an automatic conditioning of the starter facilitating its immediate restart.

A most preferred embodiment will incorporate features of all the embodiments above described. It should be self evident, however, that such features can be utilized individually or in any combination thereof with obvious benefits accruing therefrom.

Accordingly, a primary object of the invention is to provide pneumatic starters and like turbine powered devices which are economical to fabricate, most efficient and satisfactory in operation, adaptable for use in a much greater field of application than would normally be expected and extremely safe and relatively maintenance free in use thereof.

Another object is to provide pneumatic starters which are sufficiently compact, sufficiently efficient, sufficently dependable, sufficiently safe, sufficiently reasonable in cost and sufficiently maintenance free to render possible a general use thereof throughout industry.

A further object is to provide pneumatic starters and like powered devices with a highly advantageous means and manner of construction and application of its nozzle unit which facilitates a ready interchange thereof and at the same time a simpler and more efficient way to shroud its turbine rotor.

Another object is to provide a new and improved construction for the housing of a pneumatic starter and other turbine powered devices which render them more efficient and adaptable in use and simpler and more compact in their construction.

A further object is to provide a pneumatic starter wherein the use of the energy content of the gaseous fluid applied to power its rotor is maximized and the relatively cool spent fluid which results is optimally utilized to maintain a relatively cool condition of the bearings, seals, gear boxes, controls and other critical component parts of the starter, thereby to substantially minimize the requirements for maintenance or replacement of its parts.

Another object of the invention is to provide a means and mode of incorporating a new and improved system and control within and in connection with a pneumatic starter capable of functioning to preclude overspeed of its turbine rotor and the potentially undesirable consequences thereof.

A further object is to provide a nozzle unit for a turbine assembly, particularly advantageous in the use thereof in an engine starter, constructed to include as an integral part thereof a shroud or liner for the turbine rotor to which it applies.

A still further object is to provide a turbine powered engine starter featuring a compact, simplistic construction which enables a quick and easy assembly of its housing and interrelation of its component parts.

An additional object is to provide a new and improved means and mode of channeling and utilizing the gaseous fluid applied to drive a turbine rotor, particularly advantageous in application to the construction and performance of a turbine powered engine starter.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein are shown some but obviously not necessarily the only forms of embodiment of the invention, FIG. 1 is a perspective view of one illustrative embodiment of the present invention having the form of a turbine powered engine starter;

FIG. 2 presents a longitudinal sectional view thereof, with parts displaced in part for convenience of disclosure;

Figure 5:
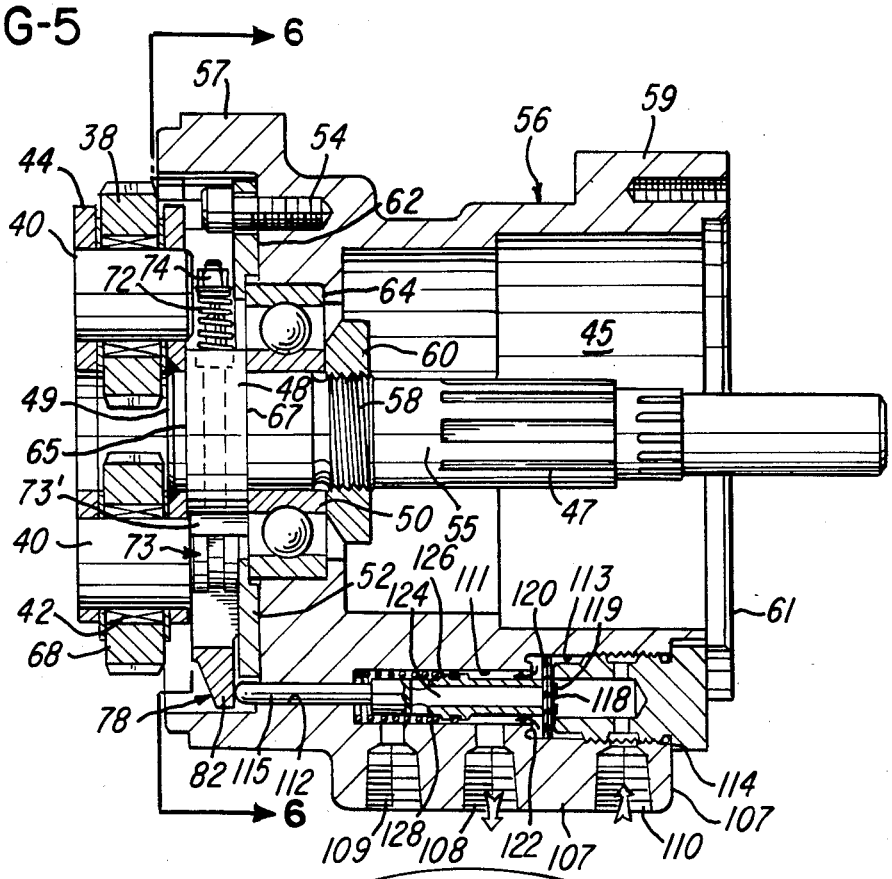
FIG. 5 is an enlarged cross-sectional view of a gear box, bearing and air valve assembly portion of the starter of FIGS. 1–4 which telescopically interfits with and forms a coaxial extension of one end of its air turbine assembly, the opposite end of which is capped by the air inlet and nozzle assembly of FIG. 2.
Figure 6:
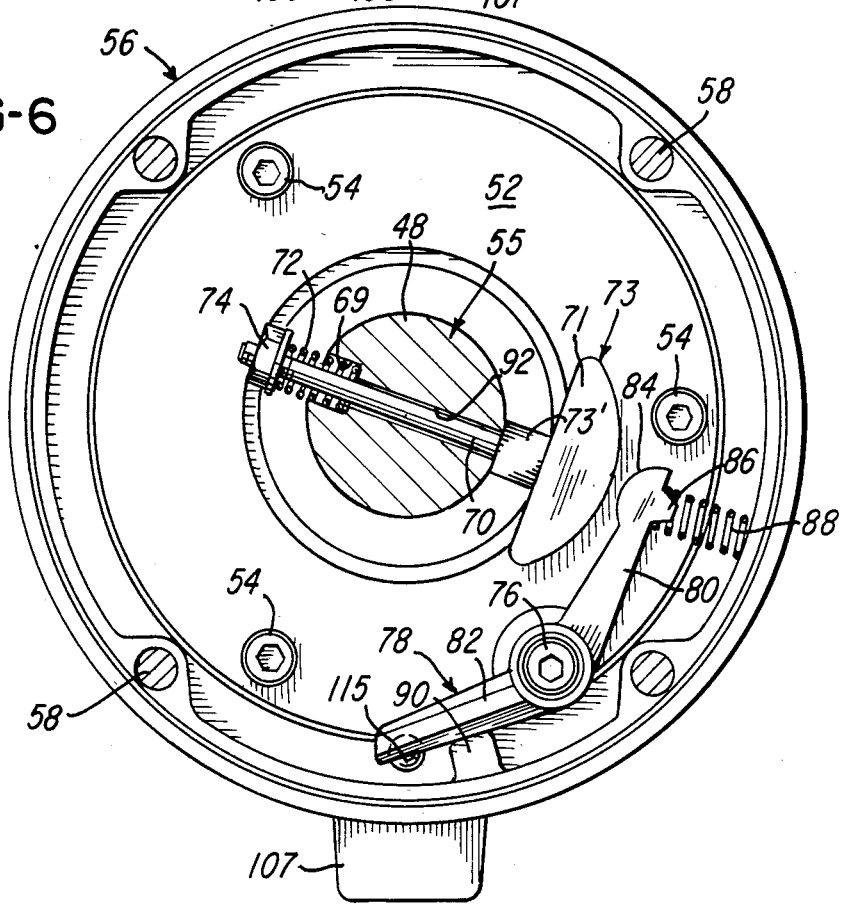
FIG. 6 is a view taken on line 6—6 of FIG. 5.
Figure 13:
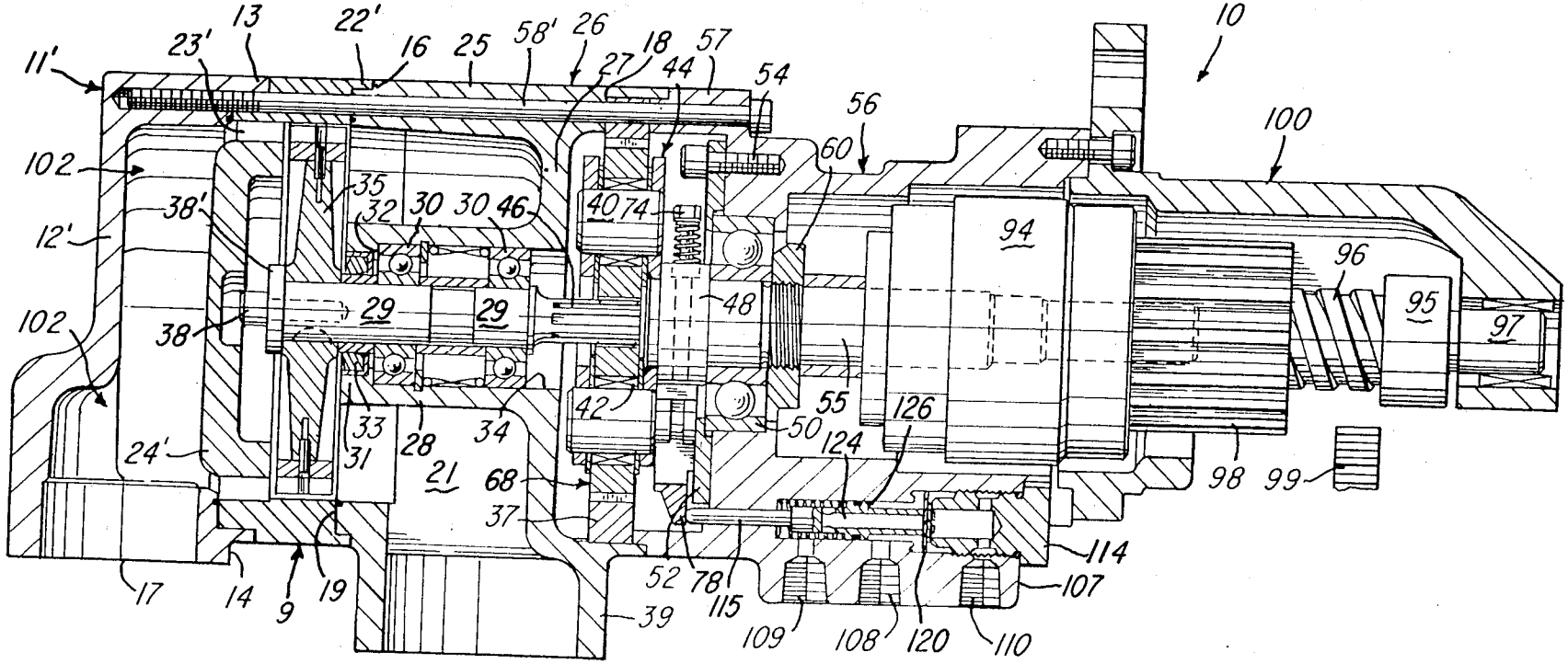
Figure 14:
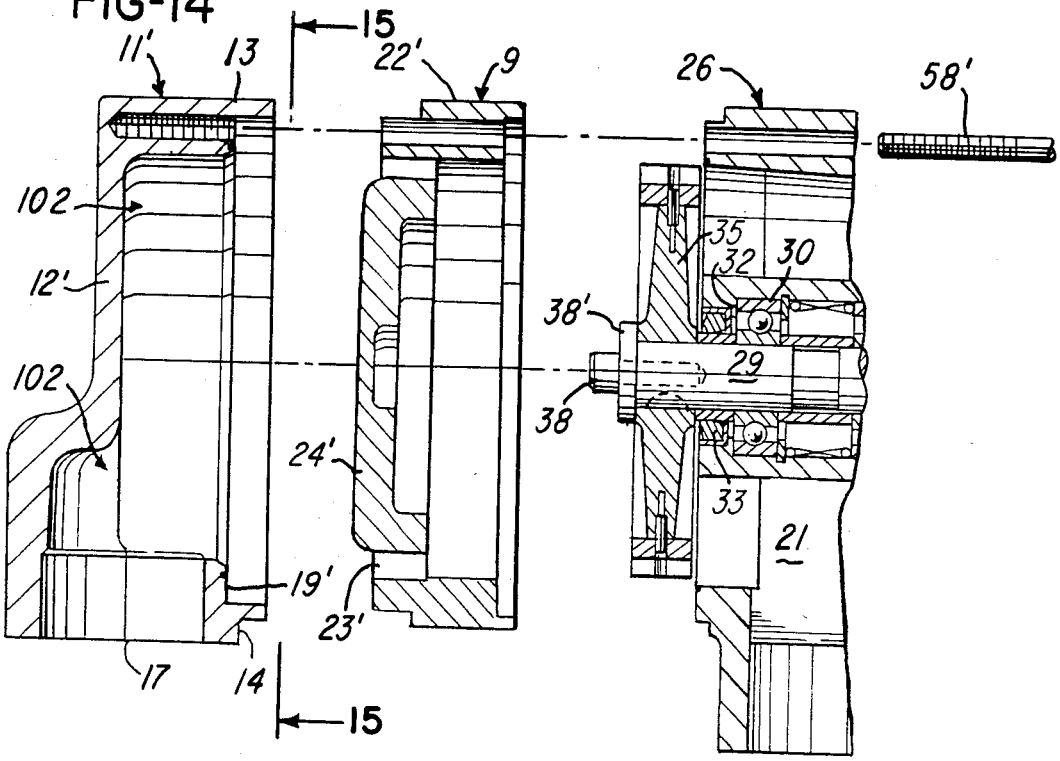
Figure 15:
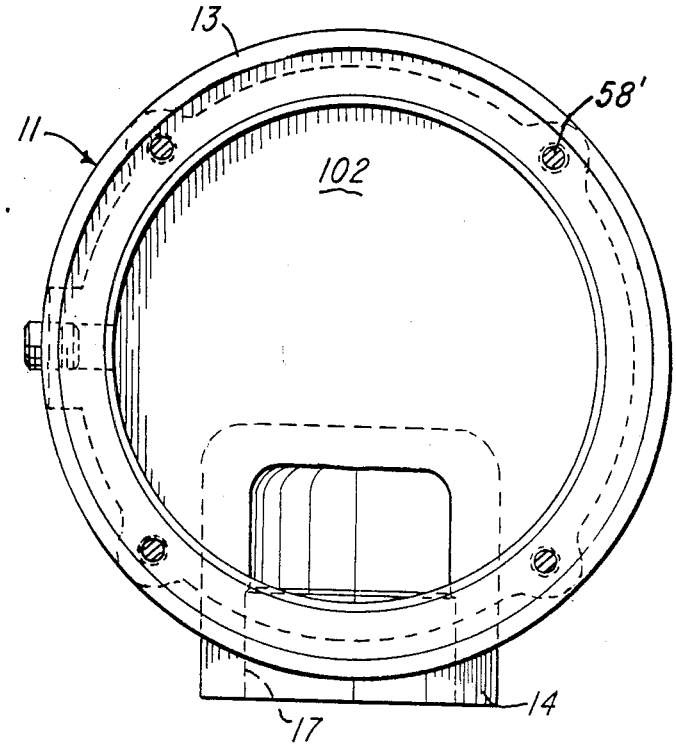

FIGS. 7–9 successively illustrate the tripping, tripped and reset conditions of the trip valve and the control system shown in FIGS. 5 and 6;

FIG. 10 is a schematic further demonstrating the system for application and control of the gaseous fluid which is used to power the turbine rotor as well as the system for operating the trip valve which is embodied in the starter to insure safety in its use;

FIGS. 11 and 12 are views taken respectively on lines 11—11 and 12—12 of FIG. 7;

FIG. 13 is a longitudinal section of a further preferred embodiment of the invention;

FIG. 14 is an exploded view of that portion of the starter of FIG. 13 comprised of the end cap embodying its air inlet, the nozzle unit which together with the end cap defines its air inlet chamber and a segment of its air turbine assembly including its turbine rotor and a portion of the drive system of which it forms a part; and FIG. 15 is a view taken on line 15—15 of FIG. 14.

Like parts are designated by like numerals throughout the drawings.

The embodiment of a starter shown in FIGS. 1–12 features a housing formed in four sections respectively designated 11, 26, 56 and 100, the section 11 of which defines its inlet end. These sections are end abutted and telescopically interfit in series relation. Note that sections 11, 26 and 56 each form an interrelated part of a distinctive, separate, sub-assembly, respectively (a) an air inlet and nozzle assembly, (b) a turbine assembly and (c) a gear box, bearing and air valve assembly.

More particularly, the outermost portion of the section 26 has the shape of a tubular shell, defines the outer wall 25 of the turbine assembly and has a counterbore in one end producing in its inner surface an outwardly facing generally annular shoulder 18 the plane of which is adjacent, parallel to and spaced axially from that of the annular surface which defines said one end of said wall 25. Both said planes are perpendicular to the generally central longitudinally extending axis of said housing section 26. The opposite end of the wall 25 is cut back at its outer periphery to define thereon an annular shoulder 16 which is in a closely spaced parallel relation to the annular surface which defines said opposite end of said wall 25, faces outwardly therefrom and commonly therewith is parallel to the shoulder 18.

A ring shaped internal gear 37 (FIG. 2) has a radially outermost portion of one end face of its axial extent abutted to the shoulder 18, its opposite face in a plane parallel to and spaced inwardly from the adjacent end of the wall 25, and its outer peripheral surface abutted to the wall surface which bounds said counterbore. As so positioned, gear 37 is concentric to the aforementioned generally central longitudinally extending axis of the housing section 26.

A generally annular web 27 integral with and projected radially inward of the inner surface of the wall 25 is in a spaced, parallel relation to and slightly inward of the shoulder 18 and gear 37. Integrated with the radially innermost edge of the web 27 and concentric with the aforementioned axis of the housing section 26, is a tube 28. The tube 28 projects from and perpendicular to that surface portion of the web 27 which is remote from gear 37 to position its projected extremity in the plane of the remote end of the wall 25. The projected extremity of tube 28 has an integral annular flange 31 directed radially inward thereof which is counterbored to produce therein a narrow annular shoulder 32 which faces outwardly of the tube 28. The inner wall surface of the tube 28 bounds a bore 34 and is in a concentric spaced relation to a shaft 29 which projects therethrough by way of the opening bounded by the flange 31.

The inner surface of the tube 28 is lined by a ring shaped seal unit 33 and a bearing assembly 30, 30. The seal unit 33 fills the counterbore in the flange 31 and radially bridges the space between the wall surface which bounds said counterbore and the shaft 29 which projects therethrough. The radially innermost portion of the seal 33 is defined by an axially extended bearing ring which positions immediately about and provides a bearing surface for the shaft 29. One end face of this bearing ring is located to be co-planar with the inwardly facing surface of the flange 31 which itself is abutted by the outer race of a ball bearing unit 30 while the inner race of said ball bearing unit is end abutted to and forms a direct coaxial extension of said bearing ring and an additional bearing surface for the shaft 29.

A lock ring the outer peripheral portion of which is lodged in a groove formed in and circumferentially of the inner surface of the tube 28 immediately following the bearing 30 has the radially innermost portion thereof projected to bear on the adjacent face of the outer race of this bearing unit to thereby fix this unit against axial movement. A second identical ball bearing unit 30 is inserted within the tube 28 to bear on its inner surface, provide a further bearing surface for the shaft 29 and position coaxial with and in longitudinally spaced relation to the first mentioned bearing unit 30 by means of an interposed sleeve which has a coaxial end abutted relation to their respective inner races. A coil spring is interposed between and has the ends thereof respectively biased against said lock ring and the facing outer race of the axially spaced bearing unit 30 to complete the bearing assembly for the shaft 29 and thereby insure a free and balanced rotation of said shaft within and coaxial with the tube 28. The face of the inner race of said second bearing unit, which is positioned adjacent but spaced inwardly of that end of the tube 28 most adjacent the ring gear 37, is end abutted by an outwardly directed radially projected shoulder 29' formed on and integral with the shaft 29. The shoulder 29' serves to maintain the components of said bearing assembly in positions which preclude their relative axial movement.

The axially extended bearing ring which defines the radially innermost limit of the seal 33 projects outwardly from and slightly beyond the plane of the adjacent end surfaces of the housing section 26 and the tube 28 to have its projected extremity provide an abutment surface for one end of the cylindrically configured tubular hub of a rotor 35 which mounts about and in keyed relation to that end portion of the shaft 29 which is adjacent and immediately outward of the seal 33. The opposite end surface of the rotor hub and the projected extremity of the end portion of the shaft to which it mounts are formed and positioned to be co-planar and commonly abutted by an annular washer 38' clamped thereto by the head of a bolt 38 the body of which is projected through the washer and threadedly anchored in a tapped bore directed inwardly of the adjacent end of the shaft 29, at its center and coaxially therewith.

The rotor 35, the outer diameter of which is somewhat less than that of the inner diameter of the adjacent end of the wall 25 of the housing section 26, comprises a disk portion integral with, extending circumferentially of and projecting radially outward of its hub to mount circumferentially of its radially outermost surface an interconnected hoop. A series of turbine buckets are integrated with and arranged circumferentially of the radially outermost surface of said hoop. The details of the rotor 35 and in particular those of said hoop and the manner of its interconnection with the rotor disk correspond, preferably, to those of the turbine rotor set forth in U.S. Pat. No. 4,507,047 and reference is made thereto and the specification and drawings thereof in this respect.

The end portion of the shaft 29 remote from that mounting the rotor 35 positions within and in a concentric relation to the ring gear 37 and is so formed to produce thereon a pinion 46.

That end portion of the housing section 26 adjacent the rotor 35 is capped and axially extended by a housing end cap assembly comprised of the cup-shaped housing section 11 and a nozzle unit 36, in the course of which said nozzle unit aligns with the rotor 35.

More particularly, the section 11 comprises a base portion 12 integrally connected with and projected from and generally perpendicular to the outer edge of the inner face of which is a generally tubular wall structure 13 the projected extremity of which defines its mouth. Also formed integral with, projected from and perpendicular to a generally central area of the inner surface of the base portion 12 is a tubular boss 15, the axial extent of which is less than half that of the wall structure 13. The mouth of the wall structure 13 is distinguished by two concentric counterbores the axial length of the first or outer of which is relatively short in comparison to that of the second or inner thereof. The base or inner limit of each counterbore is defined by a radial annular shoulder formed in the inner surface of the wall structure 13. These shoulders form axially spaced steps which are in parallel planes. The radially innermost of these shoulders is relatively narrow and seats one end of a cylindrical, thin-walled, tubular element 22 the axial length of which corresponds to the depth of said second counterbore and the outer peripheral surface of which is relatively slip fit to and coextensive with its bounding wall surface.

The nozzle unit 36 includes a central cup-shaped body portion 24 having an annular base projecting from and perpendicular to the outer edge of which is a shallow cylindrical wall portion. Arranged circumferentially of and integrated with the outermost peripheral wall surface of said shallow wall portion is a series of equidistantly and closely spaced nozzle formations. The element 22, which forms part of and completes the nozzle unit, has that half of the axial extent thereof which is innermost of the wall structure 13, when said element and the nozzle unit of which it forms a part is inserted therein, shrunk fit or otherwise integrated with and about the nozzle formations 23. As will be seen, the resultant nozzle unit is so sized and shaped as to be complementary to the rotor 35. Note that the element 22 is fabricated of a hardened wear and temperature resistant material.

In the assembly of the nozzle unit to the section 11, the annular base of its body portion is seated over the projected extremity of the boss 15 and fixed thereto by screws applied therethrough and anchored in the backing end portion of the boss 15, with a ring seal sandwiched therebetween, by virtue of which the entire nozzle unit including the element 22 is telescopically seated within the mouth of the section 11 and a relatively small annular chamber 102 is defined about the boss 15 at what is in fact the inlet end of the starter housing.

The radially outermost shoulder 19 of the two defined by the counterbores directed inwardly of the mouth of the cup-shaped housing section 11, the wall surface which bounds the outer peripheral limit of the shoulder 19 and the lip at the mouth of cup which peripherally rims the opening thereto mutually define a female socket having a configuration complementary to and enabling a quick, easy telescopic female-male interfit of the mouth of the cup shaped housing section 11 to and about the stepped extremity of the wall portion 25 which is adjacent the rotor 35. In the course of this procedure rotor 35 slip fits within the outer half of the length of the element 22 to position its buckets in direct alignment with the nozzles 23 of the unit 36. The result of this arrangement is that the outer radial limits of the rotor buckets position in a concentric, very closely spaced relation to the bounding portion of the element 22 which then serves as a shroud for the buckets but more importantly as a liner for that portion of the inner wall surface of the wall structure 13 which then bounds said rotor.

Figure 1:
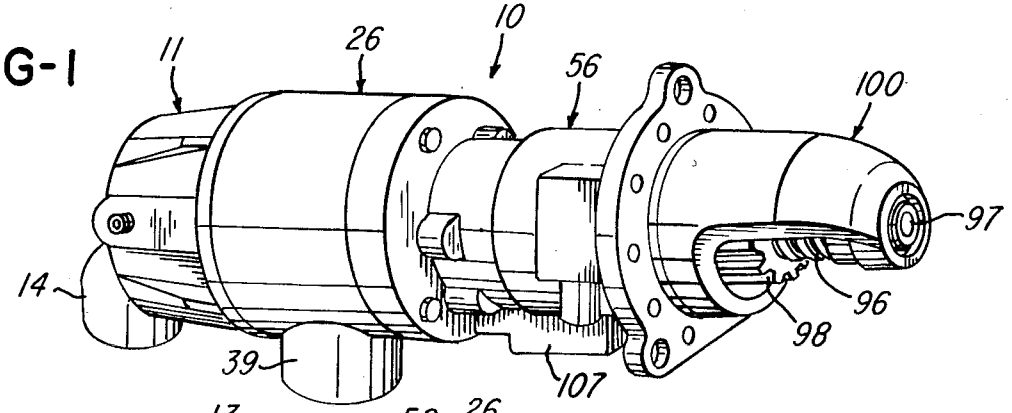
Figure 2:
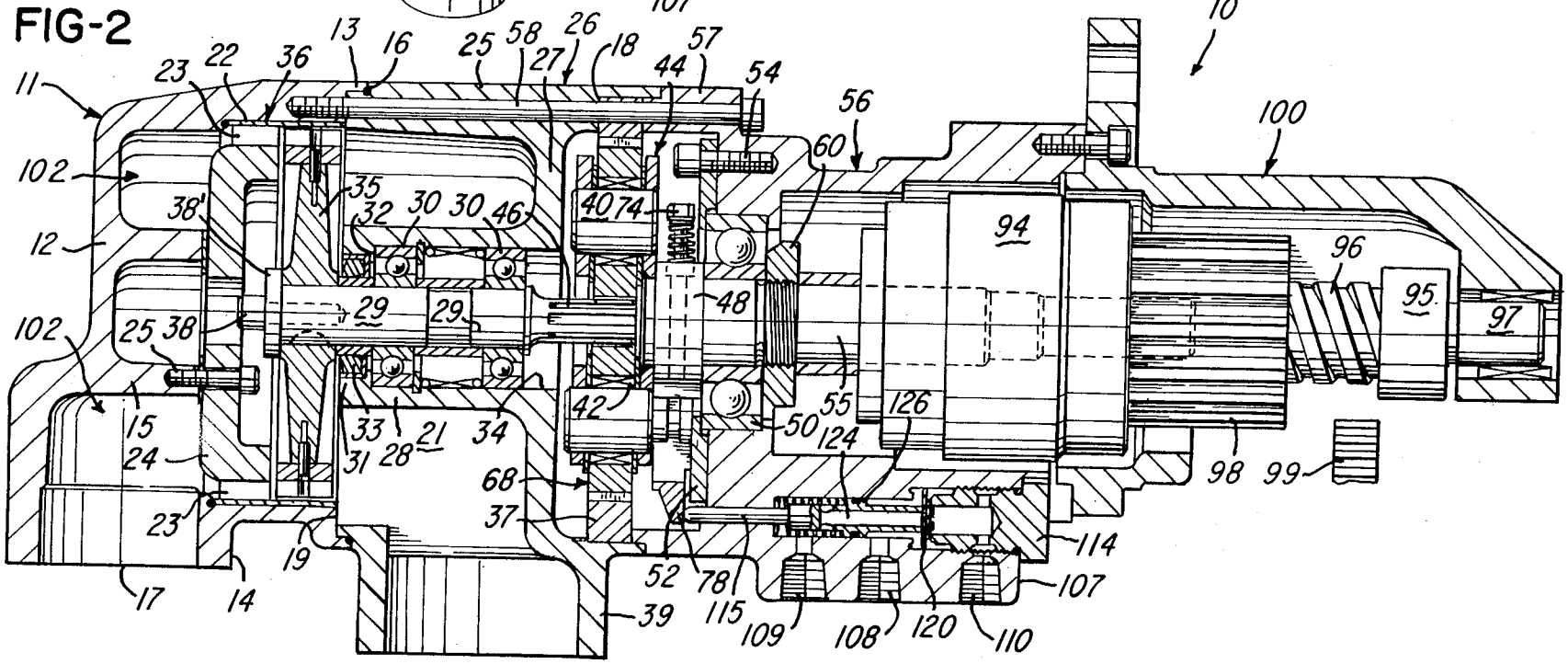
Figure 3:
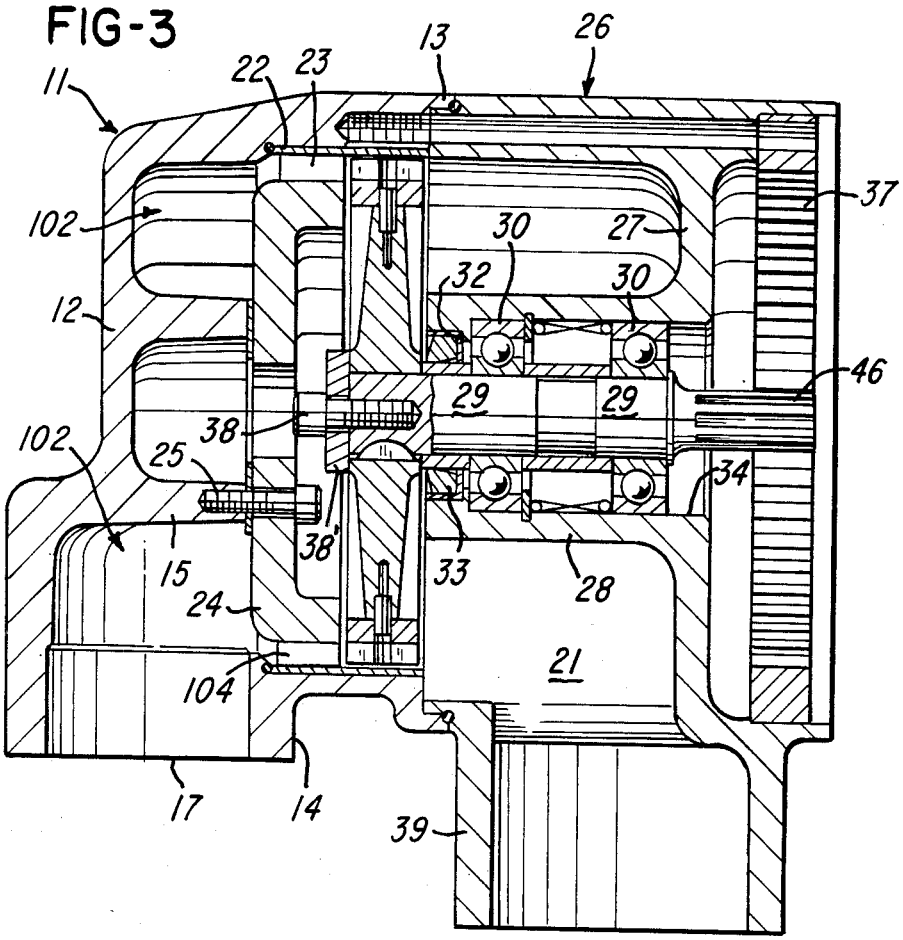
FIG. 3 illustrates an enlarged sectional view of the turbine assembly portion of the starter together with an applied end cap which incorporates its nozzle unit
Figure 4:
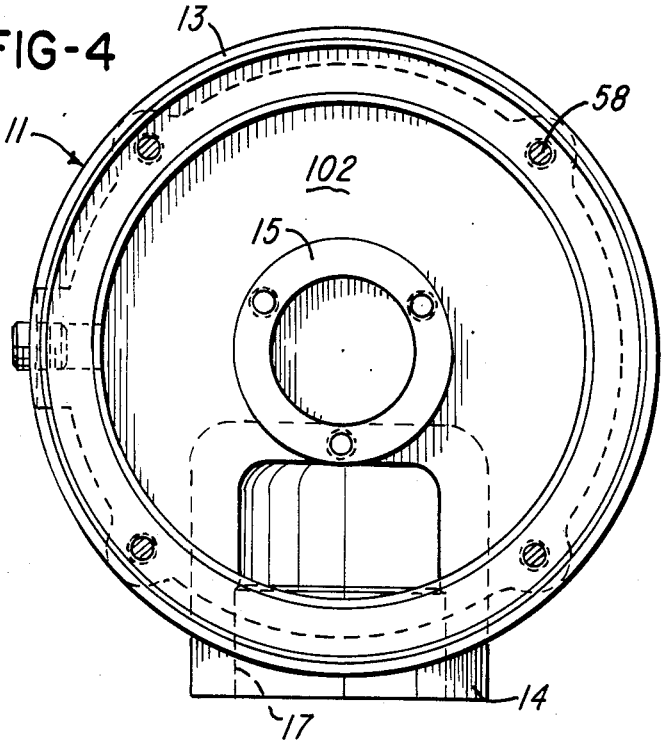
FIG. 4 is a view of the open end of said end cap per se.

As seen in FIG. 2, a groove provided in a circumferentially of the radially innermost limit of the shoulder 16 partially nests therein an "o"-ring which insures a seal of the joint produced by the interfit ends of the cup shaped housing section 11 and the section 26. At the same time a seal applied for similar purposes is provided in and circumferentially of the radially innermost limit of the shoulder to which the inner end of the element 22 seats on assembly of the nozzle unit 36 to the section 11.

A relatively narrow radial portion of the base 12 of the section 11 extending from the boss 15 to the outermost surface of the wall structure 13 is offset from the plane of the base of the central body portion of the nozzle unit to axially increase the depth of chamber 102 and the axial extent of the wall structure 13 within the limits thereof. This accommodates the provision of a radial opening in the wall structure 13, at its base, the diameter of which is markedly greater in dimension than that of the axial depth of the chamber 102 other than in the location of said offset. Such opening is extended outward of the wall structure 13 by a tubular boss 14 which forms therewith an inlet port 17 for delivery to the chamber 102 of a flow of gaseous fluid under pressure from a source of supply 120. Thus, the chamber 102 is an air inlet chamber the air delivery opening to which is quite large considering its limited volumetric capacity. Moreover, the only outlets for flow from said chamber 102 are provided by the nozzles 23 of the nozzle unit 36 which align with the buckets of the rotor 35.

The size of the port 17 and the inner extension thereof within the limits of said offset radial portion of the base 12 and the limit on the volumetric capacity of the chamber 102 results in a substantial pressure head on the gaseous fluid delivered to chamber 102 which is such to insure the maintenance of a substantially uniform pressured flow thereof through the nozzles 23 at a high velocity, the nature of which is so effective and efficient that it enables the utilization of a large percentage of the energy content of the fluid to drive the rotor 35. The efficiency of the starter is thereby optimalized. Furthermore, the consequences of the maximalizing the use of the energy content of the fluid in driving the rotor is that the resulting spent fluid is relatively cool and it is further cooled by immediately providing for its expansion within the chamber 21 of the air turbine assembly about the tube 28 downstream of the rotor. The path provided thereby for the exit of the cooling spent fluid enables it to effectively function to maintain a relatively moderate temperature of the power transmission system of the starter including critical components thereof such as its bearings, seals, controls and gear boxes. Attention is directed to the fact that the spent fluid exits from the chamber 21 by way of a radial discharge opening in its bounding wall portion 25, at the bottom thereof. This radial opening is rimmed and extended by an outwardly projected tubular boss 39. Note that the inner diameter of the boss 39 has a dimension slightly greater than that of the radial opening which it extends and the radial opening itself has a diameter the dimension of which is in excess of one half of that of the axial length of the wall portion 25. This contributes to the pattern of flow and utilization of the fluid delivered to power the turbine rotor, both as to the extent of utilization of its energy content and its cooling effect in its spent form.

The net result of the foregoing is a minimalization of maintenance and replacement requirements over an extended period of time and consequently an assured balance of the rotor 35 and performance of the starter.

A significant feature of the assembly of the housing section 26 and its end cap assembly 11, 36 is that the element 22 automatically establishes a portion of its length as a shroud for the rotor 35 as well as a protective liner for the surrounding housing wall structure. Another factor of importance in the use of the described structure is the ease and speed of assembly and disassembly of the nozzle unit and the end cap defined by the section 11 of the starter housing with reference to each other as well as to the end portion of the air turbine assembly to which they apply. In addition the nature and character of the nozzle unit and its quick release embodiment in the cup-shaped section 11 of the starter housing enables a simple, economical and advantageous design and system for a most efficient pressured application of gaseous fluid to the rotor 35 and an unexpectedly advantageous subsequent use thereof as described. An obvious important improvement in the art deriving from the construction and ease of disassembly described is that the nozzle unit may be quickly and easily interchanged to suit a variety of requirements and applications of a given starter.

The previously referred to gearbox, bearing and air valve assembly is embodied in connection with the housing section 56 which has a tubular shape, a bore 45 and one end portion 57 thereof which is flanged and distinguished by two counterbores to form therein concentric outwardly facing annular shoulders 62 and 64. These shoulders have a limited axial spacing and lie in longitudinally spaced parallel planes which are parallel to that of the adjacent annular extremity of the end portion 57 and perpendicular to the longitudinal axis of the bore 45. The radially innermost shoulder 64 is relatively narrow and abutted by the axially innermost face of the outer race of a ball bearing 50, the major axial extent of the outer peripheral surface of which bears on its bounding wall surface (FIG. 2). The outermost shoulder 64, which is more closely adjacent the outer extremity of the end portion 57, is relatively broad. The outer face of the outer race of the bearing 50 together with the balance of its outer peripheral surface are firmly engaged and overlapped by a complementarily formed inner peripheral edge portion of an annular retention plate 52 secured in overlying fixed relation to the shoulder 62 by screws 54. Said outer extremity of the end portion 57 is cut back at its outer periphery to define thereon a narrow annular shoulder to provide it with a configuration formed to closely and telescopically interfit with that end portion of the wall 25 of housing section 26 adjacent the ring gear 37 and it is so applied.

In the interfit of end portion 57 to the wall portion 25 said planar annular end surface portion of its extremity seats to the radially outermost portion of the outer face of the gear 37 and holds this gear in abutted relation to the shoulder 18, while the narrow offset shoulder at its outer limit firmly abuts the adjacent extremity of the wall portion 25 and the outer peripheral surface of the section 56 between said planar annular surface and said offset shoulder bears on and coextensively with the wall of the counterbore having shoulder 18 as its base.

Radially outermost flange portions (FIGS. 2 and 6) of the end portion 57 not only include parts thereof which interfit with the wall portion 25 as just described but also provide therein a series of four circularly and equidistantly spaced bores 63 the lines of which are parallel to the longitudinal axis of the bore 45 of the housing section 56. These equidistantly spaced bores are each directly aligned with corresponding bores extending through ring gear 37, from face to face thereof; through the wall portion 25 the length thereof; and blind bores directed inwardly of the shoulder 19, and axially of the wall structure 13 of which it forms a part. This construction and arrangement provides four groups of series related aligned bores each group of which defines, in effect, a long bore accomodating the body of a long bolt 58 the threaded extremity of which is firmly engaged in a blind bore in the wall structure 13 and the head of which firmly seats to a radial shoulder on the remote side of a part of the flange of the end portion 57 through which the bolt is applied. The net result of the application of the four bolts is that in this simple and expeditious fashion the end cap assembly including the housing section 11, housing section 56, wall portion 25 and thereby housing section 26 are all tied firmly together, with appropriate seals being provided therebetween as required, at one and the same time. Simultaneous therewith, as will be seen, the internal elements of the starter and complementary parts forming part of the described assemblies and/or supported or contained thereby are brought together simply and effectively to insure their optimal performance and functional interrelation.

Further in this respect, the bore 45 of housing section 56 accomodates a shaft 55 which is radially centered as it projects therethrough, the length thereof. One end 49 of shaft 55 is positioned essentially co-planar with the outer extremity of the end portion 57 while its opposite end projects outwardly of and, to a limited extent, beyond the remote extremity of housing section 56.

Shaft 55 is distinguished by having successive sections of its length successively changed as to their diameter. A short portion 48 of its length adjacent its end 49 is uniformly increased as to its diameter to produce thereon a cylindrical radial projection the axially spaced extremities of which provide parallel radially projected annular shoulders 65 and 67. A portion of its length supported by bearing 50 adjacent its end 49. The innermost shoulder 67 abuts the outer face of the inner race of the bearing 50 which bears on the shaft portion immediately following its portion 48 beyond which a short portion 58 of the length of shaft 55 is threaded and threadedly engaged by a nut 60 which abuts the inner face of the inner race of the same bearing 50. The latter is thereby clamped between nut 60 and shoulder 67 for rotation with the shaft. Beyond this threaded portion an elongate portion 47 of the shaft 55 is slightly reduced as to its diameter and splined following which a short portion of the length of the shaft is further reduced in diameter and differentially splined. The remainder of the shaft, uniformly further reduced as to its diameter and smooth has the major portion of its length projected outwardly of the extremity 61 of the housing section 56 remote from its end portion 57.

The pinion 36 forms part of a planetary gear train providing a speed reduction assembly by means of which the shaft 29 is linked in driving relation to the end spaced coaxial shaft 55. More specifically the pinion 36 is positioned between and in mesh with a plurality of circumferentially spaced planet gears 68 which are coplanar and simultaneously in mesh with the internal ring gear 37.

Gears 68 are mounted by needle bearings 42 for free rotation on pivot pins 40 which bridge and have their ends press fit in aligned apertures in axially spaced, coaxially aligned, centrally apertured plate units 44. The plate units 44 have aligned portions of their peripheral edges interconnected by straps to form therewith a cage within which said gears 68 are supported and protectively contained. This cage is integrally connected to the end 49 of the shaft 55, by welding, as seen in FIG. 2, to form a coaxial extension thereof which is perpendicular thereto. As will be obvious, shaft 55, its integrated cage and the contents thereof are applied to the housing section 56 at one and the same time, and interconnected therewith as previously described and prior to the assembly of the section 56 to and its interconnection with the section 26 and the other sections of the housing upstream thereof. The planet gears 68, three in number, are actually placed in mesh with the pinion 46 of the shaft 29 as and when the end portion 57 of the housing section 56 is applied, interfit and connected to form an extension of the wall portion 25.

The end portion of the housing section 56 remote from its end portion 57 is provided with three counterbores which extend inwardly of its projected extremity to produce in its inner wall surface three axially spaced shoulders, the innermost of which is in a plane perpendicular to its central longitudinally extending axis, in the vicinity of the nut 60 and spaced therefrom. Such counterbores expand the bore 45 within the limits thereof to accommodate therein an overload friction clutch 94, for example an inertial Bendix, the driving clutch element of which has a splined connection to the shaft portion 47. A suitably sized spacer sleeve interposed between the inner end of clutch 94 and nut 60 insures an appropriate positioning of the clutch elements of the Bendix with reference to the shaft 55. Through the medium of the clutch 94 the shaft 55 is placed in driving relation to a coaxial output shaft 96. The latter is distinguished by a helical thread having a relatively high lead angle. An output pinion 98 having a complementary internal thread is threadedly engaged to the shaft 96 to normally position immediately adjacent the output side of the clutch unit 94. The projected end portion of the shaft 96 which is free of thread is supported in and contained by a bearing in the outermost end of the housing section 100. The innermost end of the housing section 100, which is generally tubular in character, is externally flanged and stepped in a manner complementary to the end portion of the housing 56 with which it interfits and it is secured thereto, to form a direct coaxial extension thereof, by axially applied screws. The housing section 100 not only has a streamlined configuration but is cut away at what may be considered the bottom of its outer end portion to expose an underportion of the shaft 96 and the pinion 98 so the starter may be appropriately positioned and the pinion 98 properly aligned with and placed in its normally axially spaced relation to the teeth of an engine flywheel and applied thereto for its intended function as and when necessary.

Since an overload friction clutch such as that herein referred to as well as its function in the operation of a starter are well understood by those versed in the art and are not in and of themselves an element of the present invention, they are neither shown nor further described.

Important parts of the starter embodied and housed in the section 56 are the air valve assembly and its controls. Reference is made to FIGS. 5 and 6 in this respect. Note that the portion 48 of shaft 55 has a diametral bore 92 centered between its axial limits which includes a counterbore 69 in one end thereof the annular base of which seats a coil spring 72. Projected through bore 92 and spring 69 is a rod 70. Integrally connected with one end of the rod 70 exterior to the shaft portion 48 is a weight providing it with a radial head 71 the radially outermost surface 73 of which is formed on a uniform radius and provides an arc symmetrically positioned with respect to the rod. The radially innermost surface of the head 71 is a flat which subtends said arc, has a narrow rectangular configuration and defines a plane perpendicular to said rod. Immediately of and in connection with said head 71, in a position radially inward thereof, is a rectangular block of material the radially innermost limit of which is normally in bearing relation to the shaft portion 48 immediately about the bore 92 at one end thereof. At the same time an outer side surface of this block 73' positions in bearing relation to the adjacent surface of the plate unit 44 welded to and integrated with the end 49 of the shaft 55. Applied over the threaded projected extremity of the rod 70 at the end thereof opposite the head 71 and to the outermost end of the spring 72 is a washer and nut 74. As will be obvious, dependent on the adjustment of the nut 74 with reference to the rod 70, one may achieve a selected compression of the spring 72 and thereby a selected force inhibiting the radial outward movement of the head 71 with reference to the shaft 55 to any significant degree until when and if the speed of rotation of the shaft exceeds a predetermined limit.

Positioned in substantially co-planar relation to the head 71 of the rod 70, radially outward therefrom and in a circularly displaced relation thereto, is a pivot pin 76 which extends transversely of the space defined between the retention plate 52 and the immediately adjacent plate unit 44 which mounts the hub of a lever 78 having arms 80 and 82 projected radial therefrom in a widely divergent relation. The arrangement is such to normally have the projected extremity of the arm 80 aligned directly with the apex of surface 73 of head 71 and in a normally radially spaced relation thereto under the influence of a spring 88. At the same time the outer extremity of the arm 82 is normally biased thereby to position in the path of the outer extremity of a piston rod 115 housed in the wall of the housing section 56 for purposes and in a manner to be further described.

The surface 84 of the projected extremity of the arm 80 most adjacent the surface 73 is also formed on a generally uniform radius but one which is substantially smaller than that of surface 73. The surface portion of the arm 80 directly to the rear of the surface 84 is flat and incorporates an integrated generally conical projection 86 which normally substantially aligns with the apex of surface 73 and that of the surface 84. The projection 86 nests within the radially innermost end of the normally aligned backing spring 88, the opposite, radially outermost, end of which is appropriately set and securely positioned in a backing wall section of the housing section 56. It is by such means and construction that the outer extremity of arm 82 is normally maintained in blocking relation to the piston rod 115.

At what may be considered its bottom, the housing section 56 has a relatively narrow wall section running lengthwise thereof increased as to its radial thickness and provided with a longitudinally extending axially directed bore one end of which opens from the downstream end of section 56 while its opposite end opens through and from the remote shoulder 62. This bore has two counterbores directed inwardly of its downstream end. At the inner end of the first and largest counterbore is an annular shoulder facing outwardly thereof a radially innermost annular portion of which presents an annular valve seat 122 rimmed by an annular relatively recessed bounding portion of said shoulder. The bounding wall portion of this first and largest counterbore 113 is distinguished by a thread formed therein extending from its entrance end for about two thirds of its axial length. The second counterbore 111 has an axial length somewhat longer than that of counterbore 113 the diameter of which is uniform and corresponds in dimension to that of the inner diameter of the valve seat 122. The inner end of counterbore 111 is defined by an annular shoulder the inner limit of which rims and defines the diameter of the remaining portion 112 of the bore 113, 111, 112 which opens from the shoulder 62.

The entrance end of the bore 113, 111, 112 is capped by the head of a generally cylindrical plug 114 the reduced diameter body portion of which is applied within and extends a substantial portion of the length of the counterbore 113 in radially spaced relation to its bounding wall, except in the area of two axially spaced cylindrical projections from its outer surface the axial extent of each of which is very short. The radially outermost surfaces of these projections are threadedly engaged with the threaded surface portion of the bounding wall. It is by such means that plug 114 may be easily but securely applied or readily removed as needs require.

A blind bore directed inwardly of the projected extremity of the body portion of the plug 114 extends axially thereof a substantial portion of its length to a point adjacent but spaced from its head to produce for said bore a bounding wall structure having a tubular configuration. Said bounding wall structure is provided with a pair of diametrically aligned apertures intermediate the aforesaid cylindrical projections the latter of which define therebetween an annular chamber of short axial extent having in communication therewith one end of a radial port 110 formed in the bounding wall portion of housing section 56. With the plug 114 in place, a ring seal applied about the body portion of the plug immediately of and between its head and the most adjacent of its cylindrical projections biases against the surfaces thereof and the immediately bounding wall portion of the counterbore 113 to seal the entrance to the bore to which the plug applies.

The projected extremity of the tubular wall portion which is created by said blind bore presents a planar annular surface 118 which is perpendicular to the central axis of the counterbore 113 and the bore of which it forms a part and is further distinguished by two pair of diametrically opposite notches 119. The notches 119 of each pair are parallel, closely spaced and radially coextensive with the portions of annular surface 118 in which they are formed.

In the fully installed position of the plug 114 the annular surface 118 is located in an adjacent axially spaced relation to the valve seat 122 and a floating valve element 120 is positioned therebetween. The element 120 has a disc form the outer periphery of which has a hexagonal configuration.

Further housed in the bore 113, 111, 112 is a piston and rod unit 115. The unit 115 includes a relatively elongate cylindrical piston body portion housed in the counterbores 111 and 113. The dimension of the outer diameter of this piston body portion is less than that of the diameter of the counterbore 111 except in the location of a cylindrical projection 126 formed integral with and projected radially of its outer surface. The projection 126 is formed with a circumferential groove in its outer surface which seats in part an o-ring which projects therefrom and defines a seal between said piston body portion and its bounding wall surface.

The piston rod of the unit 115, which is an integrally connected reduced diameter pin-like extension of the end of said piston body portion remote from the entrance to its blind bore 124, projects through and bears on the bounding wall of the section 112 of bore 113, 111, 112.

A coil spring 128 positioned within the counterbore 111 about that portion of the piston and rod unit 115 most adjacent the bore 112 has one end thereof seated to the shoulder defining the base of this counterbore and the other to the most adjacent face of the projection 126. As may be readily seen in FIGS. 5–9, two additional radial ports 108 and 109 are formed in the bounding wall portion of housing section 56 which respectively communicate with the respective annular chambers formed about the piston body portion of the unit 115 within the counterbore 111 to the respectively opposite sides of the projection 126 which forms part of a seal of one from the other and prevents any direct communication therebetween.

The air valve assembly above described, a uniquely but simply integrated internally provided part of the subject starter, provides an overspeed trip valve that functions when and if, for any reason whatsoever, the turbine rotor of the starter of which it forms a part exceeds a prescribed speed of its rotation. For simplified and efficient control of this trip valve assembly as well as providing the power to energize and drive said turbine rotor reference is made to the schematic of FIG. 10 of the drawings. As illustrated therein, associated with the above described starter is a system comprised primarily of a source 130 of a gaseous fluid under pressure and associated therewith a control valve 132 and a relay valve 138. The source 130 may be connected by way of a delivery line 131, control valve 132 and delivery line 134 to the port 110 of the starter which embodies the aforementioned air valve assembly which is in fact an overspeed trip valve. At the same time the port 108 is communicated by way of the line 136 with the starter relay valve 138 which in this case is a spool valve.

Attention is directed to FIGS. 5 and 6 of the drawings wherein the trip valve components above described and their immediate controls are shown in the respective positions they assume prior to use of the starter in which they are embodied. At this time the outer extremity of arm 82 is maintained in overlying blocking relation to the projected extremity of piston rod 115 to establish and maintain the unit of which it forms a part inwardly of bore 113, 111, 112 to the extent its innermost end is abutted to valve 120 and holds it in capping relation to and across the end surface 118 and in a rearwardly axially spaced relation to the annular valve seat 122. The trip valve components and controls referred to will remain in the condition just described when the starter is energized and applied to its intended use and for so long as it is operating properly and the speed of rotation of rotor 35 does not exceed a predetermined and preset limit. Furthermore, prior to the energization of the starter the control valve 132 is in a condition wherein it will prevent flow of gaseous fluid under pressure from source 130 to either port 110 or port 17 the latter of which leads to inlet chamber 102.

The system and apparatus of the invention in the preferred embodiment herein illustrated prescribes the following procedure for energizing the starter. Valve 132 must first be operated to communicate lines 131 and 134 as a result of which source 130 is placed in communication with port 110 to deliver therethrough, to the blind bore of plug 114, an output signal in the form of a flow of fluid under pressure which moves outwardly therefrom by way of notches 119 and past the flats on the outer periphery of the floating valve 120 to and through the port 108 (FIG. 5). In exit from port 108 this signal passes to and through the line 136 to apply to and quickly adjust the relay valve 138, in this instance a spool valve, to a full open position which allows gas to then flow from the source 130, under the required pressure, to and through the inlet port 17 to inlet chamber 102 of the starter wherein the previously described condition and effects of receipt thereof resultingly occur.

The operative device for triggering the function of the trip valve in the event of an overspeed of rotor 35 is clearly comprised of rod 70, the weight 71 connected to that end thereof adjacent the surface 84 of arm 180, nut and washer 74 at its opposite end and spring 72 thereabout interposed between the nut and washer and the base of counterbore 69 in shaft portion 48. As will be obvious, in the course of rotation of shaft 55 on drive thereof proportional to and in correspondence with the speed of rotation of rotor 35, this triggering device will inherently rotate precisely in correspondence therewith and in a balanced condition, contributed to by its lateral bearing portion 73'. The significance of the simplistic arrangement of this structure should be readily apparent, as well as the fact that by appropriate choice of the properties of spring 72 and the degree of its compression in the setting thereof by the adjustment of nut 74 with reference to rod 70 one can readily fine tune its timing to insure the trip valve will function substantially precisely as required when the preset limit of the speed of rotation of rotor 35 is exceeded.

Should the speed of rotation of rotor 35 and correspondingly the proportional speed of rotation of shaft 55 exceed the preset limit thereof during the operation of the starter, triggering device 70, 71, etc. will respond directly and positively with a smooth balanced radial movement thereof outward of shaft portion 48 against the bias of spring 72 in such a manner that its surface 73 is substantially instantaneously thrown radially outward of shaft 55 to strike the aligned portion 84 of arm 80 and drive it radially outward against the bias of spring 88 thereby to pivot lever 78 and displace arm 82 sufficiently to clear the projected extremity of piston and rod unit 115.

By virtue of the continuing flow of pressure fluid to the blind bore of plug 114 and its continuing metered passage about valve 120 and into counterbore 111 to the annular chamber defined about the adjacent end portion of the piston body of unit 115, to this point in time, prior to its movement therefrom by way of the port 108 and its delivery to provide the relay valve 138 with the output signal which it represents, there has occurred a substantial build up of pressure not only behind valve 120 but also behind the piston portion of piston and rod unit 115. Thus, simultaneous with the displacement of arm 82 from its blocking relation to the outwardly projected end of the piston rod of unit 115, valve 120 and piston and rod unit 115 are thrown forward of, displaced from the end surface 118 of plug 114 and axially displaced from each other, in the process of which valve 120 seals to and bridges valve seat 122 and the forward limit of the piston body portion bounding the inner end of the projected piston rod seats against the annular shoulder defining the base of counterbore 111. As will be obvious, the pressure fluid delivered to the blind bore of plug 114 is precluded from passage to the counterbore 111 and, noting FIG. 7, at the same time the forward displacement of piston and rod unit 115 serves to communicate diametrically opposed apertures in the inner end of the wall bounding its blind bore 124 with port 109 while the open end of bore 124, being axially displaced from valve 120, is then placed in communication with the chamber in the counterbore thereabout as well as port 108. The net result is an inflow to the counterbore 111 of residual air in line 136 and a venting of all this residual air and that in counterbore 111 by way of counterbore 124 and port 109 (FIG. 7).

FIG. 8 clearly exhibits the tripped condition of the valve assembly at this point in time, showing that as of that moment there still remains, within the blind bore of plug 114, a pressured application of signal air from the source 130. At the same time the output signal to the relay valve 138 has ceased allowing a quick shut down of the relay valve and the starter while further pressurized flow of fluid to the port 110 is virtually ceased, resulting in decay of the gaseous pressure in the blind bore of the plug 114 and the chamber of the counterbore 113. As a consequence of said decay of pressure, the piston and rod unit 115, under the influence of the spring 128, is forced back against the floating valve 120 and moves this valve therewith until it together with said valve reseat to the positions thereof shown in FIG. 5. Since by virtue of the shut down of the starter as well as the rotation of the shaft 55 the rod 70 and the head 71 thereof have been inherently retracted to their original positions, as this last occurs the bias of spring 88 once more positions the outer end of its arm 82 over the projected end of the piston 115, in blocking relation thereto. The automatic resetting operation which occurs thus allow a complete shut down of the starter without material damage thereto and prevents any possibility of gaseous signal fluid being admitted to the inlet of the starter. Accordingly, the design and function of the trip valve assembly is completely automatic and provides for an automatic reset thereof after a shutdown. The economic as well as the safety and functional benefits of the means and manner of the incorporation of this structure should be self evident.

Of considerable significance in achieving the function of the air valve assembly and the results described is the physical embodiment of the basic components thereof in a simplistic fashion in the wall structure of housing section 56. This is not only essentially fully protective of the components involved but it simplifies and renders most effective the system provided for tripping the valve assembly in a most expeditious fashion. The various features of the invention and their import as well as the consequences of their use thereof have been detailed throughout the foregoing disclosure and the benefits should be well evident therefrom to anyone versed in the art. Additional comment, however, must be made in reference to the nature of the sectioning of the housing of the starter per the present invention and the most advantageous, utilitarian features and the savings which result therefrom in the use thereof. Particular emphasis must be placed on the fact that essentially the total of the starter structure may be simultaneously assembled by the mere application of four long bolts 58. It should be eminently clear as to what degree of savings in time and efforts of assembly and disassembly and the minimilizing of maintenance requirements and cost are achieved by virtue thereof.

Moreover, the unique assembly of a nozzle unit to an end cap section of the starter housing and the resulting compact and most efficient construction of an air inlet and delivery chamber such as herein disclosed is of particular merit. Such affords an essentially direct line application of fluid to power the rotation of rotor 35 in a manner to insure that the path of flow to and through the buckets is not only direct but losses are minimized, as far as energy is concerned. This taken with the fact that the nozzle unit is distinguished by a shroud formed and positioned to serve a compound utility and function determines an ease of quick assembly and disassembly and interchange of a nozzled unit on a moments notice and with no adverse effects. For that matter, the effects are most versatile and do enable a large variety of applications of the invention embodiments not heretofore envisined. Most importantly, the invention produces a relatively small starter unit for its effective capacity and function enabling widespread industrial use and acceptance thereof the range of which far exceeds previous imagination or factual conditions which have existed in the prior art in this respect. Note the facility of the nozzle unit providing in the assembly thereof a liner and shield for the buckets of the related rotor, the structure being so simplistic and beneficial as to insure close control of safety requirement in fabricating embodiments of the invention. This is apart from the obvious benefits of the improved tripping system of the invention, which substantially eliminates the usual concern as to what may occur on malfunction of a piece of equipment such as contemplated by the present invention.

Attention is directed to the modification of the invention embodiments of FIGS. 1–12 as exhibited in FIGS. 13–15 of the accompanying drawings. The only changes found in this embodiment are with reference to the format and construction of its housing end cap 11' and nozzle unit 22. The starter shown therein is otherwise similar in detail to that of FIGS. 1–12 and further description thereof to this extent is clearly unnecessary.

Noting the exploded view of FIG. 14, end cap 11' thereof differs from end cap 11' to extent of the elimination therefrom of structure corresponding to that of the boss 15 and the shortening of the axial extent of the wall structure 13 which bounds its base 12' and projects outwardly from and perpendicular to its inner surface. The particularly improved version of the nozzle unit in FIGS. 13 and 14 exhibits a nozzle ring 24' having a peripheral bounding wall structure 22' one end portion of the axial extent of which not only serves to provide a shroud secured to and about the outer periphery of its circumferentially extending nozzle formations but the whole of its axial extent, which has a much greater radial thickness than that of the member 22, serves also to provide an additional housing section 9 which is inserted between the sections 11' and 26' in the assembly of the housing. Further note that said wall structure 22' is provided with four longitudinally directed bores which are positioned to align with the corresponding bores found in the housing sections 11, 26 and 56 to commonly receive therethrough the bolts 58' which correspond to the bolts 58 of the first described embodiment and serve to tie together, at one and the same time, all these housing sections. In addition, the wall structure 22' still provides an extension beyond the nozzle ring to encompass rotor 35 of section 26 in the application thereof to and about rotor 35 providing, in this instance also, both a shroud and a very strong liner for the buckets of the capped rotor. On assembly of housing section 9 and embodied nozzle unit 24' to housing section 11' there is thus defined therebetween an upstream inlet chamber most effective in size and compact of configuration, shaped in a manner described in reference to end cap 11' of FIGS. 1–12 but distinguished from the end cap 11' in that its interior is totally uncluttered. Benefits are achieved by elimination of boss 15 and any slight energy loss which may be occasioned by reason of its presence. Moreover, the very shallow uncluttered chamber 102 produced in the end cap nozzle assembly of this preferred embodiment lends even greater assurance of a smooth and uniform flow from chamber 102 to the downstream chamber 21 beyond rotor 35. This invention is most simplistic and like the first embodiments dictates a most economical, quick and efficient assembly of starter parts and a clean and effective operation of the resulting structure with great safety and satisfaction in its use.

From the above description it will be apparent that there is thus provided a device of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus particularly advantageous for use in a pneumatic starter and like turbine powered devices including a housing comprising a plurality of shells arranged in end abutted series relation including a first said shell which is cup shaped and provides a cap at one end of said housing, a second of said shells being comprised of a tubular outer wall portion having in connection therewith, and positioned therein in a radially spaced relation to its inner wall surface, means supporting an axially extending shaft and bearing means about said shaft providing for its free rotation therein and relative thereto and third said shell which has a generally tubular configuration and forms an axial extension of said second shell, a turbine rotor mounted in driving relation to said shaft, said rotor being located adjacent that end of said second shell which in the assembly thereof is most adjacent said cup shaped shell, means including a series of nozzles positioned at and transversely of the mouth of said cup-shaped shell to define therewith a relatively shallow inlet chamber for receipt therein of a flow of gaseous fluid under pressure and to provide a controlled flow thereof therefrom by way of said nozzles to power said rotor, said nozzles being positioned adjacent and in direct alignment with turbine buckets at the outer periphery of said rotor to provide a directed impact of the pressured flow of the fluid which passes therethrough on said buckets to drive said rotor and means defining a chamber in said housing downstream of said rotor to which spent gas passing from said rotor is directed for passage from said housing by way of an exhaust port provided in a wall portion thereof.

2. Apparatus as in claim 1 wherein said means including a series of nozzles is nested in the mouth of said cup shaped shell and releasably secured thereto to form therewith an assembly which is in capping relation to said end of said second shell which is most adjacent said cup shaped shell.

3. Apparatus as in claim 1 wherein said means including a series of nozzles is a separate unit of said apparatus the outer peripheral portion of which is a cylindrical tubular axially extended wall element which serves as a further one of said shells which is interposed between and telescopically related to both the mouth of said cup-shaped shell and the end of said second shell adjacent to which is positioned said rotor.

4. Apparatus as in claim 3 wherein the axial extent of said wall element is greater than the axial extent of the remainder of said means including a series of nozzles and a portion of its axial extent positions immediately about the outer periphery of said rotor.

5. Apparatus as in claim 1 wherein said means including a series of nozzles is nested in the mouth of said cup shaped shell and releasably secured thereto to form therewith an assembly which is in capping relation to said end of said second shell adjacent to which is positioned said rotor and the outer peripheral portion of said means including a series of nozzles is defined by a cylindrical relatively thin walled tubular element the axial extent of which is greater than that of the remainder of said means including a series of nozzles and a portion of its axial extent lines the inner surface of the wall portion of said housing immediately about the outer periphery of said rotor in a peripherally confining, protective relation thereto.

6. Apparatus as in claim 1 wherein said cup-shaped end cap includes means defining an inlet opening to said chamber which it defines with said means including a series of nozzles and said inlet opening has a cross section equal to or greater than the average depth of said relatively shallow inlet chamber.

7. Apparatus as in claim 1 wherein said exhaust port of said downstream chamber has a cross sectional area the major dimension of which is substantial as compared to that of the average axial extent of said downstream chamber.

8. Apparatus as in claim 1 wherein one side wall of said downstream chamber is defined by said turbine rotor.

9. Apparatus as in claim 8 wherein said exhaust port has a cross sectional area the major dimension of which is equal to approximately one half or more the average axial extent of said downstream chamber.

10. Apparatus as in claim 8 wherein said exhaust port has a cross sectional area the major dimension of which is substantial in comparison to that of the average axila extent of said downstream chamber.

11. Apparatus as in claim 1 wherein a radial portion of the axial extent of said shallow inlet chamber is axially extended and an inlet is provided in the area thereof for the delivery of gaseous fluid under pressure to said inlet chamber the major dimension of the opening thereto provided thereby is substantial in comparison to the axial depth of said chamber, producing thereby a substantial head of pressure on the fluid in said chamber and effecting the maintenance of an essentially uniform level of flow thereof through said nozzles and a maximized, use of the energy content thereof in the drive of said rotor and resultingly a relatively cool air exiting from said housing by way of said chamber in the process of which to serve to moderate and maintain a moderated temperature of critical parts of said apparatus and parts associated therewith.

12. Apparatus as in claim 1 wherein said third shell is applied in a telescopically related end abutted series relation to said second shell to form an axial extension of the end thereof remote from said rotor, said third shell houses a transmission system including a shaft portion thereof coupled to said rotor drive shaft through the medium of a speed reduction unit to direct the output of said rotor, as and when energized, to achieve the intended use of said apparatus and said shells are simultaneously secured in their end abutted relation simply by applying the bodies of long bolts through each of a series of coaxially aligned bores provided therein to achieve a simultaneous clamping of said shells together and at the same time establish a required positioning and interrelation of parts thereof, thereby to also facilitate their disassembly for interchange and maintenance purposes if so required.

13. Apparatus as in claim 1 wherein said third shell is provided by a generally tubular wall structure and includes means mounted to said tubular wall structure to sense the speed of rotation of said rotor as reflected by the speed of rotation of said shaft portion of said transmission system, a system for supply of said fluid under pressure to said inlet chamber, said supply system being functionally related to said means mounted to said tubular wall structure and said sensing means being operative to signal said supply system upon a sensing of the speed of rotation of said rotor exceeding a preset limit to shut down the operation of said apparatus, to avert the potential consequences of overspeed of said rotor.

14. Apparatus as in claim 12 wherein said third shell is provided by a generally tubular wall structure having an axially directed through bore in a longitudinally extending portion thereof, a trip valve being positioned in said through bore, said trip valve being operatively related to a system for providing said pressured flow of fluid to said inlet chamber and normally being in an inoperative condition and means operatively related to said shaft portion of said transmission system and operatively related to said trip valve to trigger the operation thereof at such time as the speed of rotation of said rotor exceeds a prescribed limit, said trip valve being associated with means for signalling the excess speed of said rotor to said system for providing said pressured flow of fluid to said inlet chamber to automatically shut down the supply of said pressured flow of fluid to said rotor.

15. A nozzle assembly for use in combination with a turbine rotor to direct thereto fluid under pressure to power said rotor, said nozzle assembly comprising a central body portion the outer peripheral surface of which is generally circular in transverse section, means including a series of equidistantly and closely spaced nozzle formations connected with and projecting radially outward of said outer peripheral surface of said central body portion, a thin walled tubular structure the axial length of which is substantially in excess of the axial extent of said nozzle formations, a portion of the length said tubular structure to one end thereof being secured to and about said nozzle formations to effectively form an integrated part of said assembly and have the remainder thereof project axially of and outwardly from said nozzle formations and said central body portion to which they mount to simultaneously provide a liner and shroud for bounding the outer periphery of a rotor with which the nozzle unit is aligned to serve its intended function, said thin walled structure being formed and dimensioned to be complementary to and to releasably fit within and in bearing relation to the inner surface portion of that section of the housing of the machinery to which the nozzle assembly applies.

16. A nozzle assembly as in claim 15 characterized in that said thin-walled structure is provided by a tubular element applied to form part of an engine starter comprising a starter housing formed in sections, said assembly being housed within one of said sections in a secure substantially slip fit relation thereto with the outer peripheral surface of the axial length of said thin walled tubular structure lining an inner portion of said one section of said housing and having that portion of its axial length which is substantially in excess of the axial extent of said nozzle formations in peripherally containing shrouding relation to a rotor which also positions within said one section of said housing with its buckets in an adjacent aligned relation to said nozzle formations.

17. Apparatus particularly advantageous for use in a pneumatic starter and like turbine powered devices including a housing comprising a plurality of shells arranged in end abutted series relation including a first said shell which is cup shaped and provides a cap at one end of said housing, a second of said shells being comprised of a tubular outer wall portion having in connection therewith, and positioned therein in a radially spaced relation to its inner wall surface, means supporting an axially extending shaft and bearing means about said shaft providing for its free rotation therein and relative thereto, a turbine rotor mounted in driving relation to said shaft, said rotor being located adjacent that end of said second shell which in the assembly thereof is most adjacent said cup shaped shell, means including a series of nozzles positioned within and transversely of said cup-shaped shell to define therewith a relatively shallow inlet chamber for receipt therein of a flow of gaseous fluid under pressure and to provide a controlled flow thereof therefrom by way of said nozzles to power said rotor, said nozzles being positioned adjacent and in direct alignment with turbine buckets at the outer periphery of said rotor to provide a directed impact of the pressured flow of the fluid which passes therethrough on said buckets to drive said rotor and means defining a chamber in said housing downstream of said rotor to which spent gas passing from said rotor is directed for passage from said housing by way of an exhaust port provided in a wall portion thereof.

18. Apparatus as in claim 17 wherein said means including said series of nozzles comprises a central body portion the outer peripheral surface of which is generally circular in transverse section and has a series of equidistantly and closely spaced nozzle formations connected with and projecting radially outward thereof and a cylindrical tubular wall structure the axial length of which is substantially in excess of the axial extent of said nozzle formations is shrunk fit or otherwise secured about and in a protective shrouding relation thereto and projecting axially of and outwardly from said nozzle formations and said central body portion to which they mount to simultaneously provide a liner and shroud bounding the outer periphery of the rotor with which the nozzle unit is aligned to serve its intended function.

* * * * *

UNITED STATES PATENT AND TRADEMARK OFFICE

CERTIFICATE OF CORRECTION

PATENT NO. : 4,830,571

DATED : May 16, 1989

INVENTOR(S) : Terry L. Coons

It is certified that error appears in the above-identified patent and that said Letters Patent is hereby corrected as shown below:

In the ABSTRACT, Col. 2, line 19, "all" is corrected to read -- wall --.

Col. 7, line 3, -- the -- is inserted immediately preceding "cup".

line 20, "a" (2nd occurrence) is corrected to read -- and --.

Col. 16, line 39, "envisined" is corrected to read -- envisioned --;

line 63, " 11' " is corrected to read -- 11 --.

Col. 17, line 9, " 26' " is corrected to read -- 26 --;

line 27, " 11' " is corrected to read -- 11 --;

line 28, " 11' " is corrected to read -- 11 --.

Col. 19, line 10 (Claim 10, line 3), "axila" is corrected to read -- axial --.

Signed and Sealed this

Thirtieth Day of January, 1990

*Attest:*

JEFFREY M. SAMUELS

*Attesting Officer*

*Acting Commissioner of Patents and Trademarks*